US005857308A

United States Patent [19]

Dismore et al.

[11] Patent Number: 5,857,308

[45] Date of Patent: Jan. 12, 1999

[54] DOUBLE LID SYSTEM

[75] Inventors: Timothy John Dismore, Southampton; Donald John Michael Drew, Didcot, both of United Kingdom

[73] Assignee: AEA Technology plc, Didcot, England

[21] Appl. No.: 912,309

[22] Filed: Jul. 14, 1997

Related U.S. Application Data

[63] Continuation of Ser. No. 445,014, May 22, 1995, abandoned, which is a continuation of Ser. No. 280,389, Jul. 25, 1994, abandoned, which is a continuation of Ser. No. 848,699, Mar. 9, 1992, abandoned.

[30] Foreign Application Priority Data

May 18, 1991 [GB] United Kingdom ..... 9110796

[51] Int. Cl.[6] ..... B65B 7/28; B65B 43/40

[52] U.S. Cl. ..... 53/50; 53/75; 53/507; 53/170; 53/319; 53/321; 53/330; 220/259; 220/323

[58] Field of Search ..... 53/50, 64, 76, 53/88, 264, 274, 281, 284.5, 319, 321, 322, 330, 505, 75, 507, 508, 170; 220/256, 259, 323

[56] References Cited

U.S. PATENT DOCUMENTS

| | | | |
|---|---|---|---|
| 3,243,936 | 4/1966 | Anderson | 53/381.4 |
| 4,494,586 | 1/1985 | Picard . | |
| 4,519,519 | 5/1985 | Meuschke et al. | 220/323 X |
| 4,580,694 | 4/1986 | Hempelmann et al. | 220/256 |
| 4,643,328 | 2/1987 | Lorenzelli et al. | 220/323 X |
| 4,693,278 | 9/1987 | Wilson et al. | 220/323 X |
| 4,883,637 | 11/1989 | McDaniels | 220/323 X |
| 5,287,676 | 2/1994 | Erbse et al. | 53/284.5 X |

FOREIGN PATENT DOCUMENTS

| | | |
|---|---|---|
| 54494 | 6/1982 | European Pat. Off. . |
| 2323934 | 4/1977 | United Kingdom . |
| 2038921 | 7/1980 | United Kingdom . |
| 2218663 | 11/1989 | United Kingdom . |

*Primary Examiner*—Linda Johnson
*Attorney, Agent, or Firm*—William H. Holt; William R. Hinds

[57] ABSTRACT

A double lid system is provided with an electric motor (44) to actuate mechanisms to release the lid (20) from a drum (18) and simultaneously clamp the lid (20) to a door (14) of a port (or vice versa), and with an electric motor (74) to withdraw the door (14) from the port to open the port (or to close it). The system is monitored by sensors (60,62,64,82) associated with an electronic logic interlock to ensure the correct sequence of operations of the motors (44,74). The sensors (60,62,64,82) and the motors (44,74) are readily demountable for remote maintenance or replacement. The door-opening motor (74) may he a linear actuator cooperating with a part-helical slot (80) to open the door (14) and then swing it clear of the port.

7 Claims, 2 Drawing Sheets

DOUBLE LID SYSTEM

This is a continuation of application Ser. No. 08/445,014 filed May 22, 1995, now abandoned, which is a continuation of application Ser. No. 08/280,389 filed Jul. 25, 1994, now abandoned, which is a continuation of application Ser. No. 07/848,699 filed Mar. 9, 1992, now abandoned.

This invention relates to a double lid system whereby a first container may he sealed to a port of a second container, the first container and the port each having a respective lid which lids can he clamped together.

Double lid systems are often used where hazardous materials are being handled, for example to enable a hazardous material in a drum to he transferred into a glove box or vice versa; the hazardous material might he radioactive, or toxic, or might include pathogenic micro-organisms. Once the lids have been clamped to each other they can he opened as a single unit, providing communication between the insides of the two containers hut minimising the likelihood of contamination of the external surfaces of either of the two lids. To be sure of safe operation it is important that certain operations are done in the correct sequence, for example to ensure the port lid is not opened unless the first container has first been sealed to the port, or to ensure the lids are not opened before being clamped together. One such lid is described in GB 2 218 663 A, which incorporates some mechanical interlocks to prevent incorrect operations, hut to prevent all possible incorrect operations by mechanical means would necessitate very complex mechanisms.

According to the present invention there is provided a double lid system for use with hazardous materials comprising a first cylindrical container being openable at one end thereof, a first lid for the cylindrical container for closing the end; a second container including a port for gaining access thereto, a second lid for opening and closing the port; the first container including a peripheral seal for sealing engagement about the port and to the first lid, a second peripheral seal cooperating with the second lid for sealing to the port and to the first lid. The system further includes a first catch mechanism for securing the first lid to the first container, the first container incorporating engagement means for cooperating with the first catch mechanism, a second catch mechanism for securing the lids together. The system further includes a first sensor for providing a first signal indicating the proximity of the first lid to the second lid, and a second sensor for providing a second signal indicating if the lids are secured together. A first motor includes a coupling means for operating the first and second catch mechanisms, and a second motor includes a drive mechanism means arranged for opening and closing the second lid with respect to the port, the motors being operable in response to the first and second signals. The first and second motors are located within the second container and are connected to the coupling and to the drive mechanism means respectively, and are secured thereto by slidable latch means so as to be readily detachable therefrom.

A third sensor may also he provided to provide a third signal indicating the proximity of the second lid to the port-defining means, the motors being operable in response to the third signal also. A fourth sensor may also he provided, to provide a fourth signal indicating when the second lid is fully open, the second motor being operable in response to the fourth signal.

Preferably the motors are electric motors. In the preferred embodiment the second motor comprises a linear actuator arranged to move the second lid along an axis perpendicular to the plane of the lid, the system including a part-helical cam groove such that operation of the linear actuator causes both linear displacement of the second lid and also swinging of the second lid about the said axis so the port is unobstructed. Alternatively the second lid might be connected by a hinge mechanism to the port-defining means, the second motor being arranged to swing the second lid open or closed about the hinge mechanism.

Desirably both the motors and all the sensors are readily detachable, so that remote maintenance of the system (for example by a robot or by a manipulator slave arm) is facilitated. The system may also incorporate a third motor arranged to move the first container into or away from contact with the port-defining means, the third motor also being operable in response to the first, second and third signals.

The invention can ensure all steps in the operation of the double lid system are carried out in the correct sequence. The signals from the sensors are preferably supplied to a control system utilising programmable logic control (PLC) electronics, which supplies control signals to the motors. The control system may he connected to a computer to maintain a record of each operation of the system, to enable maintenance to be appropriately scheduled.

The invention will now he further described, by way of example only, and with reference to the accompanying drawings, in which.

Figure 1:
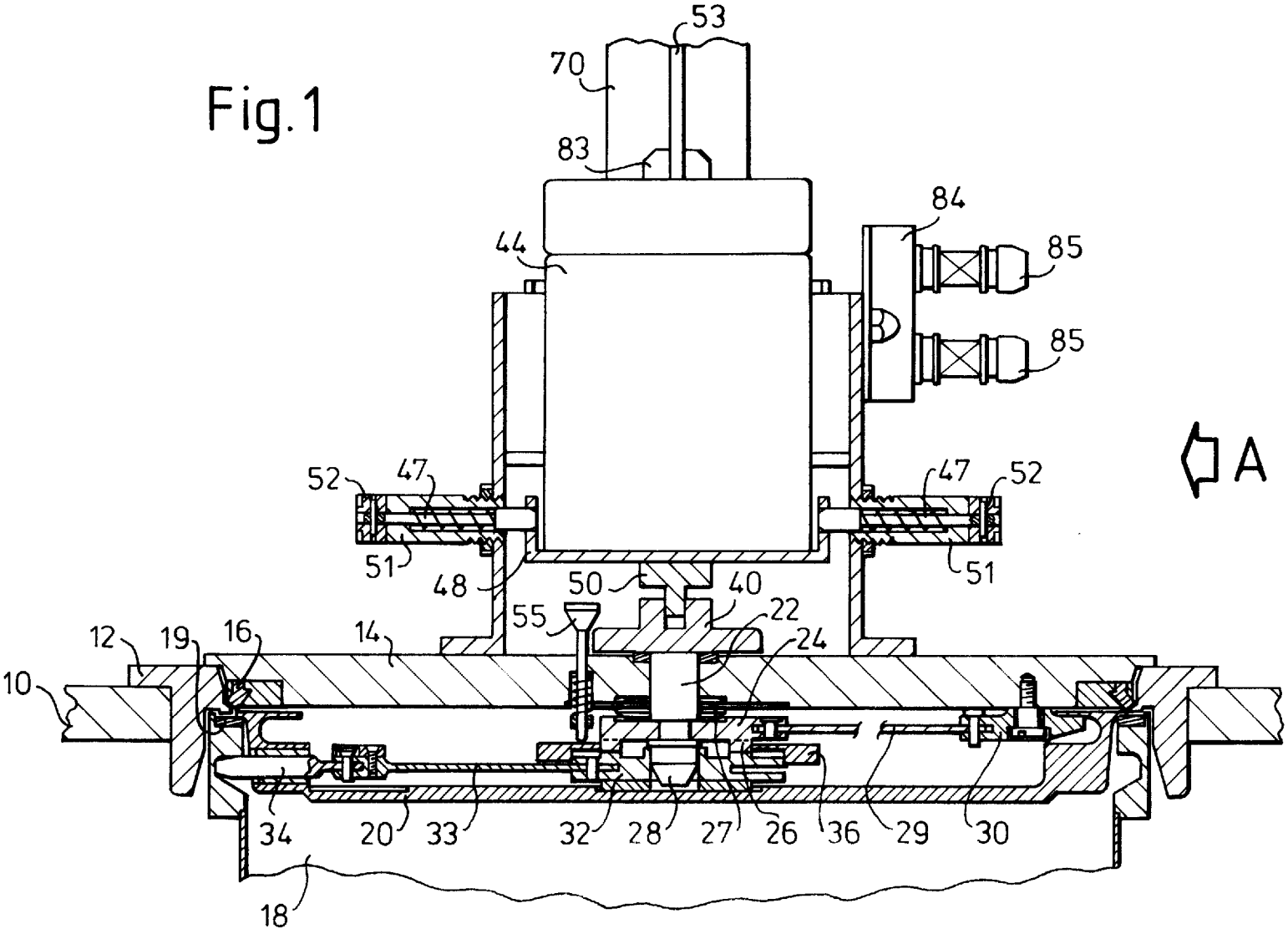
FIG. 1 shows a sectional view of a double lid system.

Referring to FIG. 1, there is shown part of a floor 10 of a cell in which is installed an annular door frame 12 defining a circular port closed by a circular door 14 with a peripheral seal 16 which seals to the frame 12. A drum 18 is shown below the floor 10, lifted into position by a jack mechanism (not shown) so the periphery of the open end of the drum 18 locates in a projecting ring of the door frame 12, a seal 19 around the open end of the drum 18 then sealing to the frame 12. The drum 18 has a lid 20 which is of slightly smaller diameter than the port defined by the door frame 12; in the position as shown the underside of the periphery of the lid 20 seals to the seal 19, while the top of the periphery of the lid 20 seals to the seal 16 on the door 14.

A rotary drive shaft 22 extends through the centre of the door 14 and on the underside of the door 14 is connected to a triangular plate 24 which defines on its lower surface an annular twenty-four toothed dog 26. The plate 24 is separated from the door 14 by leaf springs 27 and is fixed to the shaft 22 by a screw 28 with a conically tapered head. Each apex of the plate 24 is connected by a respective link arm 29 to a rotary catch 30 attached to the underside of the door 14, there being a pivotal connection at each end of the link arm 29 (only one link arm 29 and catch 30 are shown). (Rotation of the shaft 22 and the plate 24 would swing the catches 30 into the position shown, in which each catch 30 engages with a flange on the lid 20, so clamping the lid 20 to the door 14).

A similar triangular plate 32 is provided in the centre of the lid 20, with a central hole in which the head of the screw 28 locates, an annular twenty-four toothed dog on its upper surface to engage with the dog 26, and with each apex connected by a respective link arm 33 to a locking plunger 34 (only one being shown), there being a pivotal connection at each end of the link arm 33. The plate 32 is attached to the lid 20 by a retaining plate 36, fixed by three countersunk screws (not shown). The plungers 34 engage in a peripheral groove in the drum 18 so as to clamp the lid 20 to the drum 18, and can be withdrawn by rotating the plate 32.

Figure 2:
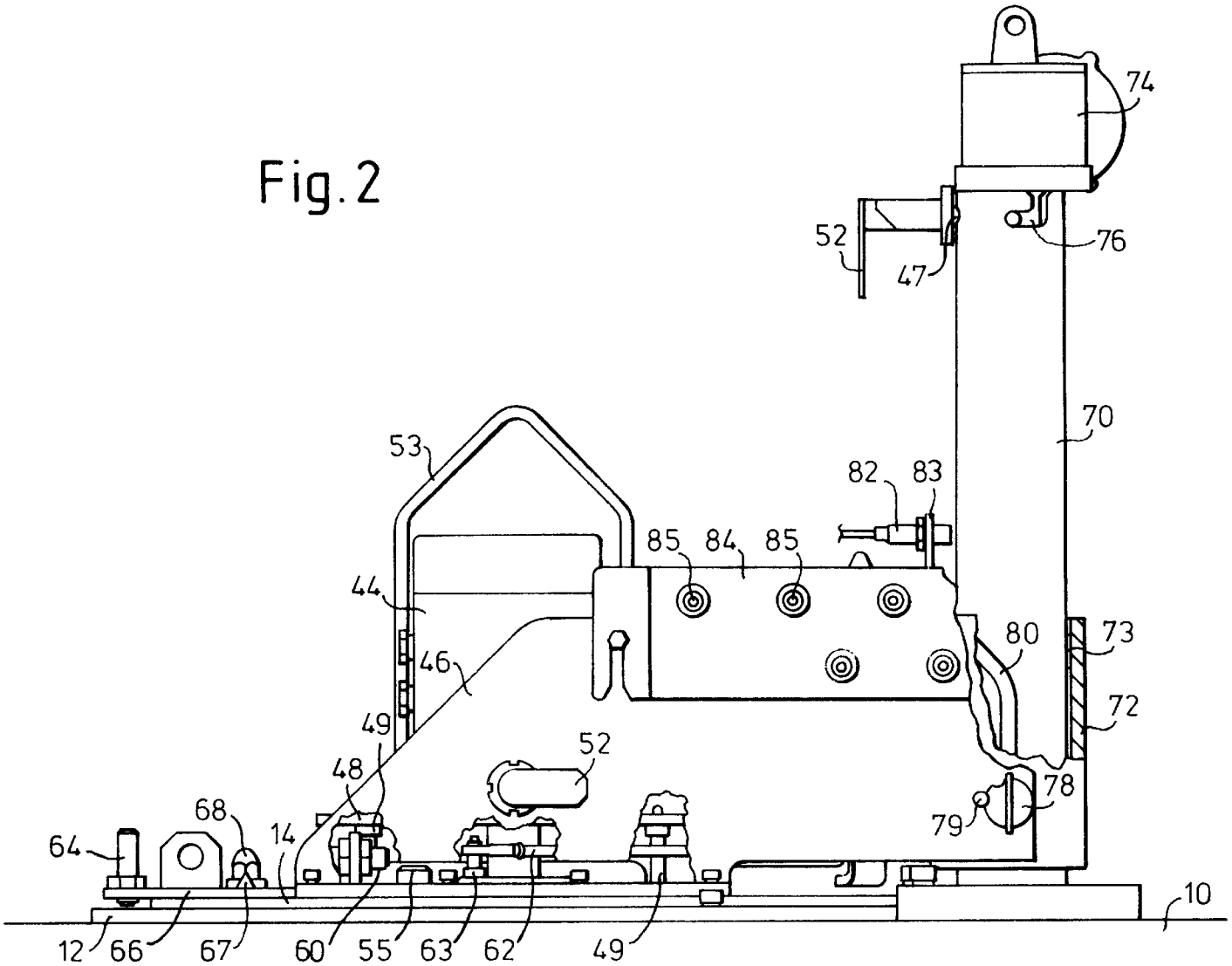
FIG. 2 shows an elevation in the direction of arrow A of FIG. 1.

On the upper surface of the door 14 the shaft 22 is connected to a circular plate 40 with a slot in its upper surface. An electric motor 44 is mounted on the upper surface of the door 14 by means of a frame 46 comprising two parallel plates; two spring-loaded plungers 47 on the frame 46 engage with apertures in a bracket plate 48 at the lower face of the motor 44, while the plate 48 is located and supported by three pillars 49 (two of which are shown in FIG. 2). A drive dog 50 projects from the lower face of the motor 44 to engage with the slot in the circular plate 40. Each plunger 47 extends through a guide cylinder 51 fixed to the frame 46, and at the end remote from the motor 44 is fixed to a radially-extending handle 52 (see also FIG. 2). The abutting faces of the cylinder 51 and the handle 52 are cam-shaped such that turning the handle through 180° withdraws the plunger 47 and holds it withdrawn. A lifting handle 53 is fixed to the bracket plate 48 and extends above the motor 44.

A spring loaded plunger 55 extends through the door 14 near the edge of the plate 40 (the plunger 55 is shown in FIG. 1 although it does not lie in the plane of the drawing), and its lower end abuts the top of the retaining plate 36 of the lid 20. If the lid 20 were to he separated from the door 14 the plunger 55 would move downwards.

Referring now to FIG. 2, in which the plunger 55 is shown in its lower position indicating that no lid 20 is adjacent to the underside of the door 14, a first proximity sensor 60 is fixed to the door 14 in such a position as to indicate when the head of the plunger 55 is raised. A linear potentiometer 62 is connected between a pin 63 fixed to the circular plate 40 and a similar pin (not shown) on the frame 46, so as to indicate the angle through which the plate 40 is turned. A second proximity sensor 64 is attached to the periphery of the door 14 so as to indicate if the door 14 is touching the door frame 12. The two proximity sensors 60 and 64 are mounted on a common mounting plate 66 which is located by a dowel 67 and secured by a locking bolt 68.

Adjacent to the door frame 12 a tubular column 70 is fixed to the wall 10, protecting perpendicular to the wall 10. A short tube 72 is slidable along the column 70 by virtue of slide bearings 73 at each end, while the two plates of the frame 46 are welded to opposite sides of the tube 72 (the tube 72 and the frame 46 are shown partly broken away). A linear actuator 74 is attached to the upper end of the column by a bayonet fitting 76, and by a spring-loaded plunger 47 which locates in a hole in the column 70; the plunger 47 is operable by a handle 52 in the same way as those described above.

A linear drive shaft (not shown) protrudes from the actuator 74 within the column 70, and a lifting bobbin (not shown) is attached to its lower end such that the bobbin is free to turn about the longitudinal axis of the drive shaft; there is a transverse hole through the bobbin. The tube 72 is linked to the bobbin by a lifting pin with a handle 78 at one end; the lifting pin extends right through the tube 72 and the column 70 between one plate and the other of the frame 46, passing through diametrically opposed slots 80 (only one of which is shown) in the wall of the column 70 and through the hole in the lifting bobbin. A locking pin 79 prevents accidental withdrawal of the lifting pin. Near the wall 10 the slots 80 are parallel to the longitudinal axis of the column 70, and then follow a helical path, so that operation of the linear actuator 74 first withdraws the door 14 from the door frame 12, and then turns it through an angle of 95° so the port is unobstructed. When the door 14 is fully withdrawn in this way, a proximity sensor 82 on a mounting bracket 83 attached to the frame 46 aligns with a hole (not shown) in the wall of the column 70, so indicating that the door 14 is fully open.

A circuit board 84 carrying sockets 85 for connections to the proximity sensors 60, 64 and 82 and to the potentiometer 62, and to the motor 44 and the actuator 74, is mounted on the frame 46. The sockets 85 on the board 84 are connected to logic circuitry (not shown) outside the cell to ensure the double lid system is operated correctly. Control leads are also provided to switches or push-buttons (not shown) outside the cell.

The sequence of events in use of the double lid system is as follows:

(i) The drum 18 to which the lid 20 is clamped by the plungers 34 is raised by the jack to engage with the door frame 12 as shown in FIG. 1; the dog 26 on the plate 24 engages with the dog on the plate 32; and the plunger 55 is raised, so a signal is provided by the sensor 60.

(ii) The motor 44 is energised to turn the shaft 22 and so the plates 24 and 32 through an angle of about 60°, so as to retract the plungers 34 and simultaneously operate the catches 30, and so clamp the lid 20 onto the door 14; the potentiometer 62 enables the rotation of the shaft 22 to be monitored.

(iii) The linear actuator 74 is energised to withdraw the door 14 and the lid 20 into the cell and so open the port, the sensor 82 indicates when this opening process is complete. Objects can then he transferred through the port in the door frame 12.

(iv) The actuator 74 is energised to close the port, swinging the door 14 hack into alignment with the frame 12 and then lowering it into the closed position; the sensor 64 indicates when the door 14 is located in the door frame 12.

(v) The motor 44 is energised to turn the shaft 22 the opposite direction, so as to release the lid 20 from the door 14 and to clamp the lid 20 to the drum 18; this rotation is monitored by the potentiometer 62.

(vi) The jack lowers the drum 18 and the lid 20 away from the port; the plunger 55 springs down, so the sensor 60 no longer indicates the presence of a lid 20.

The logic circuitry prevents the following: the door 14 being opened with no drum 18 present; the door 14 being opened unless the plungers 34 are retracted and the catches 30 engaged; the lid 20 being released from the door 14 with the door 14 open; the drum 18 being lowered from the port with the port open, or with the catches 30 still engaged and the plungers 34 disengaged.

It will be appreciated that the double lid system described above is easily maintained, and that the maintenance can he carried out remotely, for example with a manipulator. The leads plugged into the sockets 85 are readily unplugged. The motor 44 can simply be removed by rotating the two handles 52 to release it from the frame 46, and then lifted off by means of the handle 53. Similarly the linear actuator 74 can be removed by turning the handle 78 to clear the locking pin 79 and then withdrawing the handle 78 (and so the lifting pin), turning the handle 52 so the actuator 74 can turn in the column 70, and turning and lifting the actuator 74 to release it from the bayonet fitting 76. The two proximity sensors 60 and 64 can both be removed by removing the locking bolt 68 and lifting the mounting plate 66 off the dowel 67; the proximity sensor 82 along with its mounting bracket 83 can be removed similarly. The linear potentiometer 62 can he removed by simply lifting it off the pins 63 at each end, after first removing the motor 44 to allow access. In each case replacement simply involves the same steps in reverse.

We claim:

1. A double lid system for use with hazardous materials, said system comprising a first cylindrical container being openable at one end thereof, a first lid for said cylindrical container for closing said end; a second container including a port for gaining access thereto, a second lid for opening and closing said port; said first container including a peripheral seal for sealing engagement about said port and to said first lid, a second peripheral seal cooperating with said second lid for sealing to said port and to said first lid; said system further including a first catch mechanism for securing said first lid to said first container, said first container incorporating engagement means for cooperating with said first catch mechanism, a second catch mechanism for securing said lids together; said system further including a first sensor for providing a first signal indicating the proximity of said first lid to said second lid, and a second sensor for providing a second signal indicating if said lids are secured together; a first motor including a coupling means for operating said first and second catch mechanisms, and a second motor including a drive mechanism means arranged for opening and closing said second lid with respect to said port, said motors being operable in response to said first and second signals; said first and second motors being located within said second container and being connected to said coupling and to said drive mechanism means respectively, and being secured thereto by slidable latch means so as to be readily detachable therefrom.

2. A system as defined in claim 1 further including a third sensor for providing a third signal to indicate the proximity of said second lid to said port, said motors being operable in response to said third signal.

3. A system as defined in claim 2 further including a fourth sensor for providing a fourth signal indicating when said second lid is fully opened, said second motor being operable in response to said fourth signal.

4. A system as defined in claim 1 wherein said drive mechanism comprises a linear actuator arranged for moving said second lid along an axis perpendicular to the plane of said lid, said system including a part-helical cam groove such that operation of said linear actuator causes both linear displacement of said second lid and also swinging of said second lid about said axis so said port is unobstructed.

5. A system as defined in claim 1 including means wherein both said motors and all said sensors are readily detachable.

6. A system as defined in claim 1 further including a third motor arranged for moving said first container into or away from contact with said port, said third motor being operable in response to said signals from said sensors.

7. A system as defined in claim 1 wherein each said catch includes a cam and a handle for rotating said cam, each said catch being releasable by turning said handle through less than one revolution.

* * * * *